US010137707B2

(12) United States Patent
Morita

(10) Patent No.: US 10,137,707 B2
(45) Date of Patent: Nov. 27, 2018

(54) INKJET PRINTING APPARATUS WITH PAIRS OF CONVEYANCE ROLLERS

(71) Applicant: RISO KAGAKU CORPORATION, Tokyo (JP)

(72) Inventor: Yoshihisa Morita, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/665,809

(22) Filed: Aug. 1, 2017

(65) Prior Publication Data

US 2018/0056672 A1 Mar. 1, 2018

(30) Foreign Application Priority Data

Aug. 24, 2016 (JP) ..... 2016-163280

(51) Int. Cl.

| | |
|---|---|
| ***B41J 2/01*** | (2006.01) |
| ***B41J 11/00*** | (2006.01) |
| ***B41J 11/08*** | (2006.01) |
| ***B41J 13/03*** | (2006.01) |
| ***B41J 29/02*** | (2006.01) |
| ***B41J 11/14*** | (2006.01) |
| ***B41J 13/00*** | (2006.01) |
| ***B65H 5/06*** | (2006.01) |
| ***B65H 5/38*** | (2006.01) |

(Continued)

(52) U.S. Cl.

CPC ..... *B41J 11/14* (2013.01); *B41J 2/01* (2013.01); *B41J 3/543* (2013.01); *B41J 11/005* (2013.01); *B41J 11/0035* (2013.01); *B41J 11/08* (2013.01); *B41J 13/0045* (2013.01); *B41J 13/03* (2013.01); *B41J 29/023* (2013.01); *B65H 5/068* (2013.01); *B65H 5/38* (2013.01); *B41J 13/103* (2013.01); *B41J 13/106* (2013.01); *B65H 2403/942* (2013.01)

(58) Field of Classification Search

CPC . B41J 2/01; B41J 11/0035; B41J 13/03; B41J 29/023; B41J 11/005; B41J 11/08; B41J 11/14

See application file for complete search history.

(56) References Cited

U.S. PATENT DOCUMENTS

2009/0002424 A1* 1/2009 Kiyama ..... B41J 3/543 347/16
2017/0057216 A1* 3/2017 Sanaei ..... B41J 3/543

FOREIGN PATENT DOCUMENTS

JP 2011-121223 6/2011
WO 2017/036741 3/2017

OTHER PUBLICATIONS

Extended European Search Report for EP 17184447.5 dated Jan. 4, 2018.

* cited by examiner

*Primary Examiner* — Kristal Feggins
*Assistant Examiner* — Kendrick Liu
(74) *Attorney, Agent, or Firm* — Greenblum & Bernstein, P.L.C.

(57) ABSTRACT

A second inkjet head, a second platen, and a second pair of conveyance rollers configured to convey a sheet toward the second platen downward with respect to a horizontal direction are arranged at lower positions than a first inkjet head arranged upstream of the second inkjet head, a first platen arranged upstream of the second platen, a first pair of conveyance rollers arranged upstream of the second pair of conveyance rollers and configured to convey the sheet toward the first plates downward with respect to the horizontal direction, respectively.

4 Claims, 3 Drawing Sheets

(51) Int. Cl.

| | |
|---|---|
| ***B41J 3/54*** | (2006.01) |
| *B41J 13/10* | (2006.01) |

INKJET PRINTING APPARATUS WITH PAIRS OF CONVEYANCE ROLLERS

CROSS REFERENCE TO RELATED APPLICATION

This application is based upon and claims the benefit of priority from the prior Japanese Patent. Application No. 2016-163280, filed on Aug. 24, 2016, the entire contents of which are incorporated herein by reference.

BACKGROUND

1. Technical Field

The disclosure relates to an inkjet printing apparatus which performs printing by ejecting inks from inkjet heads.

2. Related Art

There is an inkjet printing apparatus which ejects inks from inkjet heads to the sheet to print an image while conveying the sheet.

In such an inkjet printing apparatus, an appropriate head gap which is a gap between the sheet and each of the inkjet heads needs to be maintained to suppress a decrease in print quality.

Japanese Unexamined Patent Application Publication. No. 2011-121223 describes a technique for maintaining appropriate head gaps in an inkjet printing apparatus.

The inkjet printing apparatus in Japanese Unexamined Patent Application Publication No. 2011-121223 includes pairs of roller sets, the roller sets in each pair being provided respectively on both sides, in a conveyance direction, of a corresponding one of platens facing inkjet heads, the each roller set including a drive roller and driven rollers pressed against two portions on a circumference of the drive roller. Each pair of roller sets convey a recording medium while biasing the recording medium downward from both sides in a front end portion and a rear end portion of the corresponding platen, and thereby bring the recording medium into tight contact with the platen. An appropriate head gap is thereby maintained.

SUMMARY

In the inkjet printing apparatus described above, since two driven rollers are provided for each drive roller, the apparatus configuration is complex and large in the size. Moreover, since the curvature radius of the sheet is substantially the same as the radius of the drive roller, the drive roller needs to have a large radius, considering the load applied to a sheet, particularly a thick sheet in the conveyance thereof. This leads to an increase in the size of the apparatus.

An object of the disclosure is to provide an inkjet printing apparatus which can maintain appropriate head gaps while suppressing increases in the size and complexity of the apparatus configuration.

An inkjet printing apparatus in accordance with some embodiments includes: a first inkjet head configured to eject ink to a sheet being conveyed; a second inkjet head arranged parallel to the first inkjet head and downstream of the first inkjet head in a conveyance direction of the sheet and configured to eject ink to the sheet being conveyed; a first platen arranged to face the first inkjet head and configured to support the sheet being conveyed between the first inkjet head and the first platen; a second platen arranged to face the second inkjet head and configured to support the sheet being conveyed between the second inkjet head and the second platen; a first pair of conveyance rollers arranged upstream of the first platen in the conveyance direction and configured to convey the sheet toward the first platen downward with respect to a horizontal direction; and a second pair of conveyance rollers arranged downstream of the first platen and upstream of the second platen in the conveyance direction and configured to receive the sheet conveyed by the first pair of conveyance rollers and convey the sheet toward the second platen downward with respect to the horizontal direction. The second inkjet head is arranged at a lower posit on than the first inkjet head. The second platen is arranged at a lower position than the first platen. The second pair of conveyance rollers is arranged at a lower position than the first pair of conveyance rollers.

In the aforementioned configuration, it is possible to suppress lifting of the sheet from a state where the head gap below the first inkjet head upstream of and adjacent to the second pair of conveyance rollers is appropriate, while sending out the sheet downward with the second pair of conveyance rollers and pressing the sheet against the second platen. The appropriate head gaps for the first inkjet head and the second inkjet head can be thereby maintained.

It is possible to arrange the ink jet heads except for the most upstream inkjet head, the platens except for the most upstream platen, the pairs of conveyance rollers except for the most upstream pair of conveyance roller at positions lower than the inkjet head upstream of and adjacent to each inkjet head, the platen upstream of and adjacent to each platen, and the pair of conveyance rollers upstream of and adjacent to each pair of conveyance rollers, respectively, while suppressing increases in the size and complexity of the apparatus configuration.

Accordingly, in the aforementioned configuration, it is possible to maintain the appropriate head gaps while suppressing the increases in the size and complexity of the apparatus configuration.

The inkjet printing apparatus may further include: a third inkjet head arranged parallel to the second inkjet head and downstream of the second inkjet head in the conveyance direction and configured to eject ink to the sheet being conveyed; a third platen arranged to face the third inkjet head and configured to support the sheet being conveyed between the third inkjet head and the third platen; and a third pair of conveyance rollers arranged downstream of the second platen and upstream of the third platen in the conveyance direction and configured to receive the sheet conveyed by the second pair of conveyance rollers and convey the sheet toward the third platen downward with respect to the horizontal direction. The third inkjet head may be arranged at a lower position than the second inkjet head. The third platen may be arranged at a lower position than the second platen. The third pair of conveyance rollers may be arranged at a lower position than the second pair of conveyance rollers.

In the aforementioned configuration, the same effects as those described above can be obtained.

The inkjet printing apparatus may further include a height adjuster configured to adjust a height position of the second inkjet head together with height positions of the second platen and the second pair of conveyance rollers, depending on a type of the sheet.

In the aforementioned configuration, the appropriate head gaps can be more surely maintained by suppressing the lifting of the sheet from the platen due to the stiffness of the sheet.

The inkjet printing apparatus may further include: a first height adjuster configured to adjust a height position of the second inkjet head together with height positions of the second platen and the second pair of conveyance rollers, depending on a type of the sheet; and a second height adjuster configured to adjust a height position of the third inkjet head together with height positions of the third platen and the third pair of conveyance rollers, depending on the type of the sheet.

In the aforementioned configuration, the same effects as those described above can be obtained.

DETAILED DESCRIPTION

Figure 1:
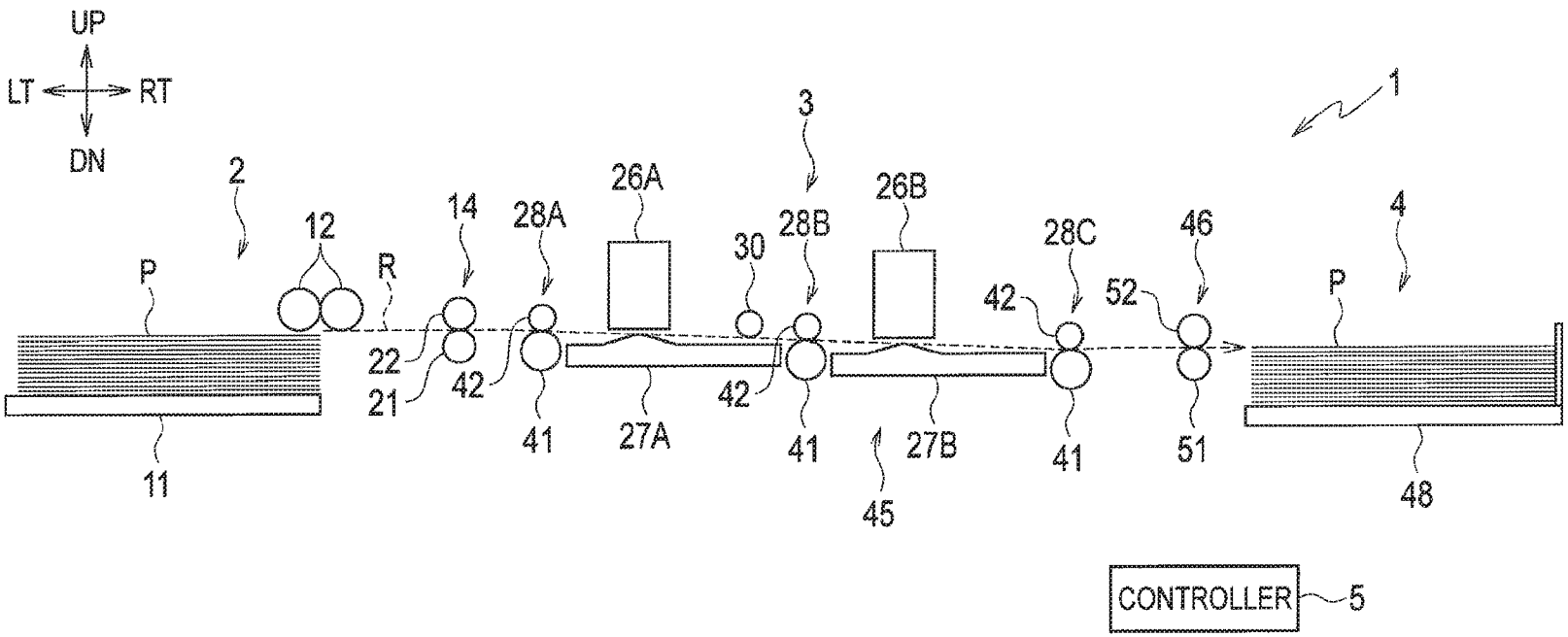
FIG. 1 is a schematic configuration diagram of an inkjet printing apparatus in an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
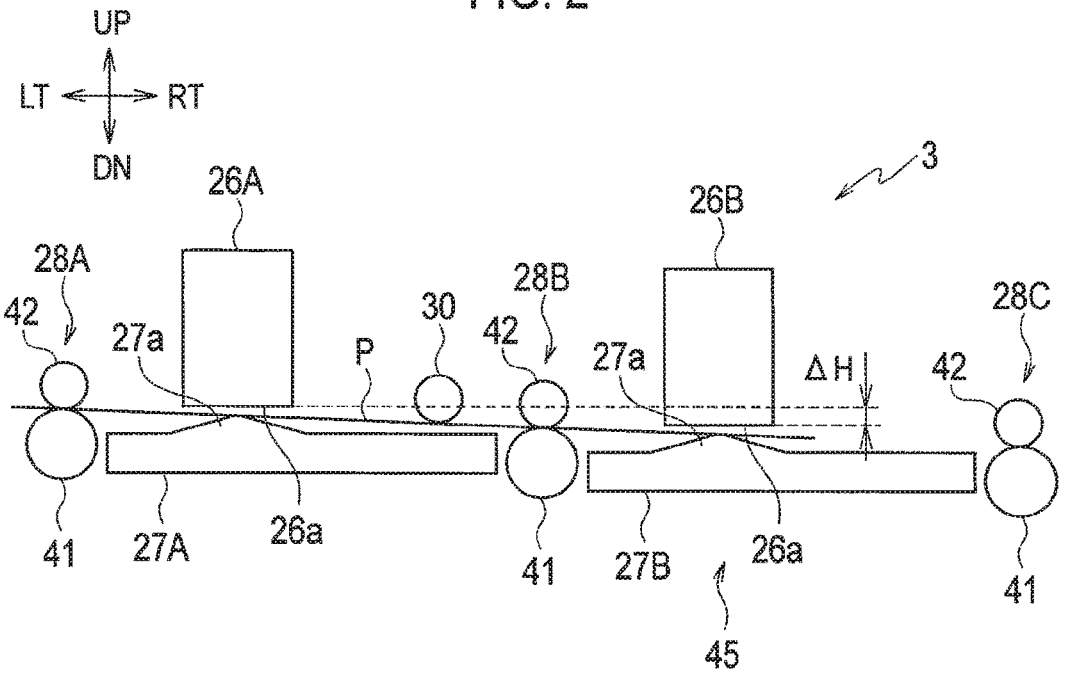
FIG. 2 is a diagram illustrating a configuration of a printer in the inkjet printing apparatus illustrated in FIG. 1.
Figure 3:
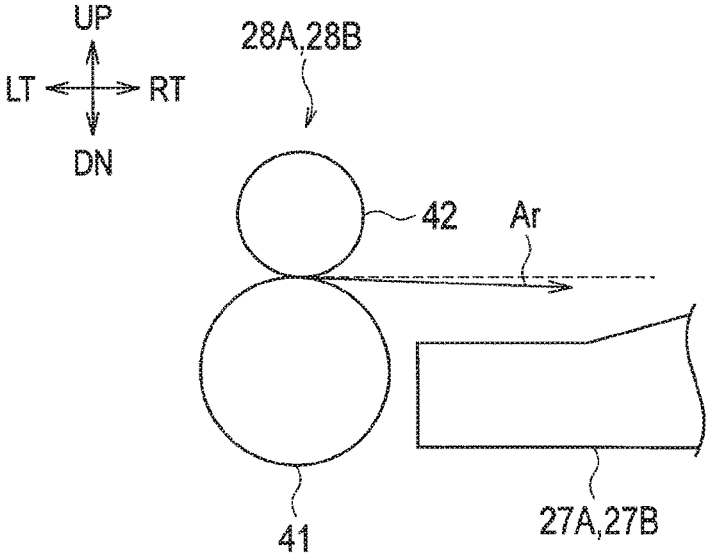
FIG. 3 is a diagram explaining a direction in which a sheet is sent out by a pair of conveyance rollers upstream of and near a platen in the inkjet printing apparatus illustrated in FIG. 1.
Figure 4:
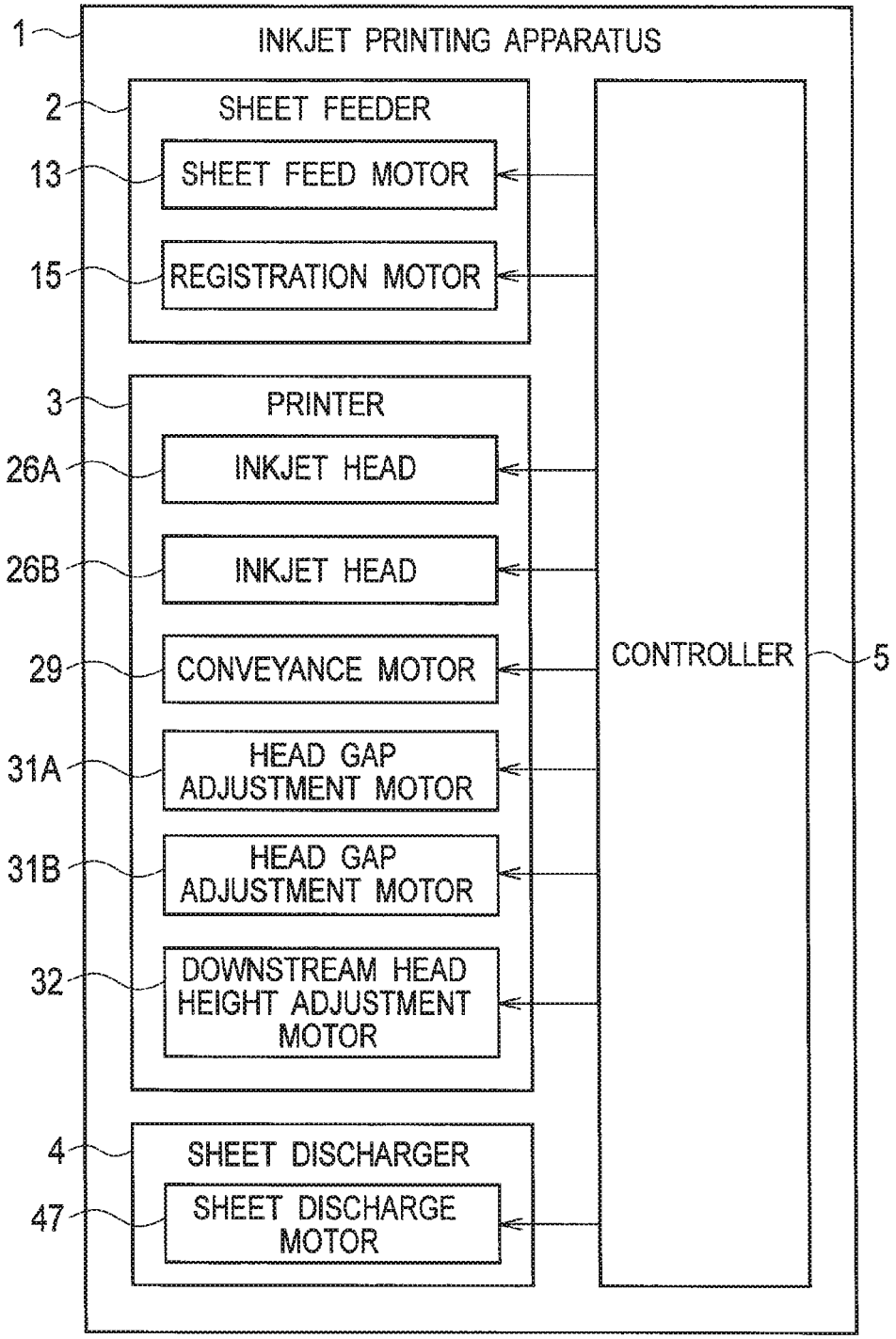
FIG. 4 is a control block diagram of the inkjet printing apparatus illustrated in FIG. 1.

FIG. 1 is a schematic configuration diagram of an inkjet printing apparatus 1 in an embodiment of the present invention. FIG. 2 is a view illustrating a configuration of a printer 3 in the inkjet printing apparatus 1 illustrated in FIG. 1 FIG. 3 is a view explaining a feed-out direction of a sheet by a pair of conveyance rollers 28A, 28B located upstream of and near a platen 27A, 27B in the inkjet printing apparatus 1 illustrated in FIG. 1. FIG. 4 is a control block diagram of the inkjet printing apparatus 1 illustrated in FIG. 1. In FIGS. 1 to 3, right, left, up, and down are denoted by RT, LT, UP, and DN, respectively. In the following description, upstream and downstream mean upstream and downstream in a conveyance direction of sheets P along a conveyance route R illustrated by a dashed arrow in FIG. 1.

As illustrated in FIGS. 1 and 4, the inkjet printing apparatus 1 in the embodiment includes a sheet feeder 2, the printer 3, a sheet discharger 4, and a controller 5.

The sheet feeder 2 feeds the sheets P to the printer 3. The sheet feeder 2 includes a sheet feed tray 11, sheet feed rollers 12, a sheet feed motor 13, a pair of registration rollers 14, and a registration motor 15.

The sheet feed tray 11 is a tray on which the sheets P being print media are stacked.

The sheet feed rollers 12 pick up the sheets P stacked on the sheet feed tray 11 one by one, and convey the sheets P toward the pair of registration rollers 14. The sheet feed rollers 12 are rotationally driven by the sheet feed motor 13.

The pair of registration rollers 14 temporarily stops each of the sheets P conveyed from the sheet feed rollers 12 and then sends out the sheet P toward the printer 3. The pair of registration rollers 14 consists or a pair of a drive roller 21 and a driven roller 22, and conveys the sheet P while nipping the sheet P with the drive roller and the driven roller 22. The drive roller 21 is rotationally driven by the registration motor 15. The driven roller 22 rotates by following the drive roller 21.

The printer 3 prints an image on each sheet P fed by the sheet feeder 2 while conveying the sheet P. The printer 3 includes inkjet heads 26A, 26B, the platens 27A, 27B, pairs of conveyance rollers 28A to 28C, a conveyance motor 29, a guide roller 30, head gap adjustment motors 31A, 31B, and a downstream head height adjustment motor (height adjuster) 32.

The inkjet heads 26A, 26B each print an image on the sheet P being conveyed by ejecting inks thereto. The inkjet heads 26A, 26B each have multiple nozzles (not illustrated) formed on an ejection surface 26*a* which is a lower surface. The multiple nozzles of each of the inkjet, heads 26A, 26B are arranged to form multiple nozzles rows, and inks of different colors are ejected from the respective nozzle rows.

The inkjet heads 26A, 26B are arranged parallel to each other along the conveyance direction of the sheet P (left-right direction). The inkjet head 26A is arranged on the upstream side and the inkjet head 26B is arranged on the downstream side. The inkjet heads 26A, 26B are arranged to be shifted from each other in a main scanning direction (direction orthogonal to the sheet surface of FIG. 1) orthogonal to the conveyance direction of the sheet P. Thus, the inkjet head 26A performs printing on a region of the sheet P on one side in the main scanning direction and the inkjet head 26B performs printing on a region of the sheet P on the other side in the main scanning direction. The inkjet head 26B is arranged at a position lower than the inkjet head 26A.

The platens 27A, 27B support the sheet P being conveyed below the inkjet heads 26A, 26B. The platens 27A, 27B are arranged below the inkjet heads 26A, 26B to face the inkjet heads 26A, 26B. The platen 27B is arranged at a position lower than the platen 27A by an amount equal to a height difference $\Delta H$ between the inkjet heads 26A, 26B.

The platens 27A, 27B are each formed in a plate shape. The platens 27A, 27B respectively have sheet supporters 27*a* configured to support the sheet P at positions facing the ejection surfaces 26*a* of the inkjet heads 26A, 26B. The sheet supporters 27*a* are formed to protrude from upper surfaces of the platens 27A, 27B.

The pairs of conveyance rollers 28A to 28C convey the sheet P such that the sheet P is passed below the inkjet heads 26A, 26B. The pairs of conveyance rollers 28A to 28C each consist of a pair of a drive roller 41 and a driven roller 42, and convey the sheet P while nipping the sheet P with the drive roller 41 and the driven roller 42. The drive roller 41 is rotationally driven by the conveyance motor 29. The driven roller 42 rotates by following the drive roller 41.

The pair of conveyance rollers 28A is arranged upstream of and near the platen 27A. A nip point of the pair of conveyance rollers 28A is at a higher position than the highest point of the sheet supporter 27*a* of the platen 27A. Moreover, the pair of conveyance rollers 28A is installed such that a common tangent of the drive roller 41 and the driven roller 42 at the nip point is a straight line tilted downward toward the downstream side. The direction in which the sheet P is sent out by the pair of conveyance rollers 28A is thereby a direction downward with respect to the horizontal direction (the horizontal plane) as depicted by the arrow Ar in FIG. 3. In other words, the pair of conveyance rollers 28A conveys the sheet P toward the platen 27A downward with respect to the horizontal direction.

The pair of conveyance rollers 28B is arranged downstream of and near the platen 27A and upstream of and near the platen 27B. A nip point of the pair of conveyance rollers 28B is at a lower position than the highest point of the sheet supporter 27*a* of the platen 27A and at a higher position than the highest point of the sheet supporter 27*a* of the platen 27B. The positional relationship between the pair of conveyance rollers 28B and the platen 27B is the same as the positional relationship between the pair of conveyance rollers 28A and the platen 27A. Specifically, the pair of conveyance rollers 28B is arranged at the position lower than the pair of conveyance rollers 28A by an amount equal to the height difference ΔH between the inkjet heads 26A, 26B. The direction in which the sheet P is sent out by the pair of conveyance rollers 28B is a direction downward with respect to the horizontal direction as in the pair of conveyance rollers 28A. The pair of conveyance rollers 28B receives the sheet P conveyed from the pair of conveyance rollers 28A and conveys the sheet P toward the platen 27B downward with respect to the horizontal direction.

The pair of conveyance rollers 28C is arranged downstream of and near the platen 27B. The pair of conveyance rollers 28C is installed such that a common tangent of the drive roller 41 and the driven roller 42 at the nip point is a straight line tilted upward toward the downstream side. The direction in which the sheet P is sent out by the pair of conveyance rollers 28C is thereby upward with respect to the horizontal direction, contrary to the pairs of conveyance rollers 28A, 28B. The pair of conveyance rollers 28C receives the sheet P conveyed from the pair of conveyance rollers 28B and conveys the sheet P upward with respect to the horizontal direction.

The guide roller 30 guides the sheet P to the pair of conveyance rollers 28B while suppressing lifting the sheet P caused by curling. The guide roller 30 is arranged above a downstream portion of the platen 27A.

The head gap adjustment motors 31A, 31B lift and lower the inkjet heads 26A, 26B relative to the platens 27A, 27B to adjust the head gaps. The head gaps are gaps between the sheet P and the inkjet heads 26A, 26B. More specifically, the head gaps are gaps between the sheet P and the ejection surfaces 26*a* of the inkjet heads 26A, 26B at the highest points of the sheet supporters 27*a* of the platens 27.

The downstream head height adjustment motor 32 adjusts the height position of the inkjet head 26B to adjust the height difference ΔH between the inkjet heads 26A, 26B. In the inkjet printing apparatus 1, the inkjet head 26B, the platen 27B, and the pairs of conveyance rollers 28B and 28C are unitized to form a unit 45. The downstream head height adjustment motor 32 lifts and lowers the unit 45 to adjust the height position of the inkjet head 26B together with the height positions of the platen 27B and the pairs of conveyance rollers 28B and 28C.

The sheet discharger 4 discharges the sheet P subjected to printing in the printer 3. The sheet discharger 4 includes a pair of sheet discharge rollers 46, a sheet discharge motor 47, and a sheet receiving tray 48.

The pair of sheet discharge rollers 46 conveys the sheet P conveyed from the pair of conveyance rollers 28C of the printer 3 toward the sheet receiving tray 48. The pair of sheet discharge rollers 46 consists of a pair of a drive roller 51 and a driven roller 52 and conveys the sheet P while nipping the sheet P with the drive roller 51 and the driven roller 52. The drive roller 51 is rotationally driven by the sheet discharge motor 47. The driven roller 52 rotates by following the drive roller 51.

The sheet receiving tray 48 is a tray on which the sheets P subjected to printing and discharged by the pair of sheet discharge rollers 46 are stacked.

The controller 5 controls operations of the units in the inkjet printing apparatus 1. The controller 5 includes a CPU, a RAM, a ROM, a hard disk, a storage unit formed of a semiconductor memory, and the like. The storage unit stores instructions which, when executed by a processor such as the CPU, causes the processor to perform processing to be described below.

Next, operations of the inkjet printing apparatus 1 are described.

When a print job is inputted, the controller 5 obtains information indicating a type of the sheet used in printing, from setting information included in the print job. Then, the controller 5 adjusts the head gaps by lifting and lowering the inkjet heads 26A, 26B relative to the platens 27A, 27B with the head gap adjustment motors 31A, 31B, depending on the type of the sheet.

Moreover, the controller 5 adjusts the height difference ΔH between the inkjet heads 26A, 26B by lifting and lowering the unit 45 with the downstream head height adjustment motor 32. Specifically, the height position of the unit 45 is adjusted such that the stiffer the type of the sheet is, the larger the height difference ΔH is. In this case, the position of the nip point between the drive roller 41 and the driven roller 42 of the pair of conveyance rollers 28C is adjusted as necessary such that the larger the height difference ΔH is, the greater the upward tilt of the direction in which the sheet P is sent out by the pair of conveyance rollers 28C is.

Next, the controller 5 starts the drive of the pairs of conveyance rollers 28A to 28C by the conveyance motor 29, and also starts the drive of the pair of sheet discharge rollers 46 by the sheet discharge motor 47. Then, the controller 5 performs control such that the sheet P is fed from the sheet feeder 2 to the printer 3.

The fed sheet P is conveyed by the pairs of conveyance rollers 28A to 28C in the printer 3. In the printer 3, since the direction in which the sheet P is sent out by the pairs of conveyance rollers 28A, 28B is downward with respect to the horizontal direction, the sheet P is conveyed while being pressed against the sheet supporters 27*a* of the platens 27A, 27B.

Now, assume that the inkjet head 26B, the platen 27B, and the pair of conveyance rollers 28B are at the same heights as the in head 26A, the platen 27A, and the pair of conveyance rollers 28A, respectively, unlike in the embodiment. In this case, lifting of a trailing end portion of the sheet P, conveyed downward by the pair of conveyance rollers 28B, above a horizontal plane in an area upstream of the pair of conveyance rollers 28B may cause the head gap for the inkjet head 26A to become smaller than a set value. Moreover, the sheet P may come into contact with the inkjet head 26A. When the head gap becomes smaller than the set value, deviation of ink landing positions may occur and cause a decrease of print quality. Moreover, when the sheet P comes into contact with the inkjet head 26A, the inkjet head 26A may be damaged.

Meanwhile, in the embodiment, the inkjet head 26B, the platen 27B, and the pair of conveyance rollers 28B are at the lower positions than the inkjet head 26A, the platen 27A, and the pair of conveyance rollers 28A, respectively. Accordingly, lifting of the sheet P from the state where the head gap below the inkjet head 26A is the set value is suppressed while the head gap for the inkjet head 26B is maintained at the set value by sending out the sheet P downward with the pair of conveyance rollers 28B and pressing the sheet P against the sheet supporter 27*a* of the platen 27B. The head gaps for the inkjet heads 26A, 26B are thereby maintained at the set values.

In an area downstream of the inkjet head 26B, upward conveyance of the sheet P by the pair of conveyance rollers 28C causes the sheet P to be pushed down, upstream of the pair of conveyance rollers 28C. Accordingly, the sheet P receives no force which causes the sheet P to be lifted from the state where the head gap below the inkjet head 26B is the set value.

During the conveyance of the sheet P in the printer 3, the controller 5 drives the inkjet heads 26A, 26B and causes the inkjet heads 26A, 26B to eject the inks to the sheet P being conveyed based on the print job. An image is thereby printed on the sheet P. The sheet P subjected to printing is discharged by the sheet discharger 4.

When the printing and discharging of a specified number of sheets is completed, the controller 5 stops the conveyance motor 29 and the sheet discharge motor 47 to stop the pairs of conveyance rollers 28A to 28C and the pair of sheet discharge rollers 46. The series of operations is thereby completed.

As described above, in the inkjet printing apparatus 1 the inkjet head 26B, the platen 27B, and the pair of conveyance rollers 28B on the downstream side are arranged at the lower positions than the inkjet head 26A, the platen 27A, and the pair of conveyance rollers 28A on the upstream side. This can suppress lifting of the sheet P from the state where the head gap below the inkjet head 26A is appropriate, while causing the sheet P to be pressed against the sheet supporter 27*a* of the platen 27B by sending out the sheet P downward with the pair of conveyance rollers 28B. The appropriate head gaps for the inkjet heads 26A, 26B can be thereby maintained.

It is possible to arrange the inkjet head 26B, the platen 27B, and the pair of conveyance rollers 28B at the lower positions than the inkjet head 26A, the platen 27A, and the pair of conveyance rollers 28A, respectively, while suppressing increases in the size and complexity of the apparatus configuration.

Accordingly, in the inkjet printing apparatus 1, it is possible to maintain the appropriate head gaps while suppressing the increases in the size and complexity of the apparatus configuration.

Moreover, in the inkjet printing apparatus 1, the height position of the inkjet head 26B is adjusted together with the height positions of the platen 27B and the pair of conveyance rollers 28B, depending on the type of the sheet. Specifically, the height position of the unit 45 is adjusted such that the stiffer the type of the sheet is, the larger the height difference $\Delta H$ is. More specifically, since the stiffer the sheet P is, the more the sheet P tends to lift from the sheet supporter 27*a* of the platen 27A, the unit 45 is arranged at a lower position to suppress the lifting of the sheet P from the sheet supporter 27*a* of the platen 27A. The appropriate head gap can be thereby more surely maintained.

In the aforementioned embodiment, there is described the configuration in which there are two sets of the inkjet head 26A, 26B, the platen 27A, 27B, the platen 27A, 27B, and the pair of conveyance rollers 28A, 28B upstream of and near the platen 27A, 27B. However, the configuration may be such that there are three or more such sets. In other words, any configuration is acceptable as long as there are two or more sets.

In the configuration including three or more sets described above, it is only necessary that the inkjet heads except for the most upstream inkjet head, the platens except for the most upstream platen, the pairs of conveyance rollers upstream of and near the platens except for the most upstream pair of conveyance rollers are arranged at lower positions than the inkjet head upstream of and adjacent to each inkjet head, the platen upstream of and adjacent to each platen, and the pair of conveyance rollers upstream of and adjacent to each pair of conveyance rollers.

Moreover, in this case, the height position of each inkjet head except for the most upstream inkjet head may be adjusted together with the height positions of the platen and the pair of conveyance rollers corresponding to this inkjet head, depending on the type of the sheet. For example, a member corresponding to the downstream head height adjustment motor 32 may be provided for each inkjet head except for the most upstream inkjet head. In the configuration including three sets described above, the member corresponding to the downstream head height adjustment motor 32 (first height adjuster and second height adjuster) may be provided for each of the two inkjet heads other than the most upstream inkjet head.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printing apparatus comprising:

a first inkjet head configured to eject ink to a sheet being conveyed;

a second inkjet head arranged parallel to the first inkjet head and downstream of the first inkjet head in a conveyance direction of the sheet and configured to eject ink to the sheet being conveyed;

a first platen arranged to face the first inkjet head and configured to support the sheet being conveyed between the first inkjet head and the first platen;

a second platen arranged to face the second inkjet head and configured to support the sheet being conveyed between the second inkjet head and the second platen;

a first pair of conveyance rollers arranged upstream of the first platen in the conveyance direction and configured to convey the sheet toward the first platen downward with respect to a horizontal direction; and a second pair of conveyance rollers arranged downstream of the first platen and upstream of the second platen in the conveyance direction and configured to receive the sheet conveyed by the first pair of conveyance rollers and convey the sheet toward the second platen downward with respect to the horizontal direction, wherein the second inkjet head is arranged at a lower position than the first inkjet head, the second platen is arranged at a lower position than the first platen, the second pair of conveyance rollers is arranged at a lower position than the first pair of conveyance rollers, and a nip point of the second pair of conveyance rollers is arranged at a lower position than a highest point of the first platen.

2. The inkjet printing apparatus according to claim 1, further comprising:

a third pair of conveyance rollers arranged downstream of the second platen in the conveyance direction and configured to receive the sheet conveyed by the second pair of conveyance rollers and convey the sheet upward with respect to the horizontal direction.

3. The inkjet printing apparatus according to claim 1, wherein:

the first platen comprises a first sheet supporter arranged at a position facing an ejection surface of the first inkjet head, protruding from an upper surface of the first platen, and configured to support the sheet; and the second platen comprises a second sheet supporter arranged at a position facing an ejection surface of the second inkjet head, protruding from an upper surface of the second platen, and configured to support the sheet.

4. An inkjet printing apparatus comprising:

a first inkjet head configured to eject ink to a sheet being conveyed;

a second inkjet head arranged parallel to the first inkjet head and downstream of the first inkjet head in a conveyance direction of the sheet and configured to eject ink to the sheet being conveyed;

a first platen arranged to face the first inkjet head and configured to support the sheet being conveyed between the first inkjet head and the first platen;

a second platen arranged to face the second inkjet head and configured to support the sheet being conveyed between the second inkjet head and the second platen;

a first pair of conveyance rollers arranged upstream of the first platen in the conveyance direction and configured to convey the sheet toward the first platen downward with respect to a horizontal direction;

a second pair of conveyance rollers arranged downstream of the first platen and upstream of the second platen in the conveyance direction and configured to receive the sheet conveyed by the first pair of conveyance rollers and convey the sheet toward the second platen downward with respect to the horizontal direction; and a height adjuster configured to adjust a height position of the second inkjet head together with height positions of the second platen and the second pair of conveyance rollers, depending on a type of the sheet, wherein the second inkjet head is arranged at a lower position than the first inkjet head, the second platen is arranged at a lower position than the first platen, and the second pair of conveyance rollers is arranged at a lower position than the first pair of conveyance rollers.

* * * * *